US012228017B2

(12) United States Patent
Holloway et al.

(10) Patent No.: US 12,228,017 B2
(45) Date of Patent: Feb. 18, 2025

(54) CONTAINMENT UNIT, CONTAINMENT SYSTEM AND METHOD FOR CONTAINING FLUID LEAKS

(71) Applicant: MARQUIX, INC., Houston, TX (US)

(72) Inventors: Robert Holloway, Katy, TX (US); Ronald Cook, Houston, TX (US)

(73) Assignee: Marquix, Inc., Houston, TX (US)

( * ) Notice: Subject to any disclaimer, the term of this patent is extended or adjusted under 35 U.S.C. 154(b) by 219 days.

(21) Appl. No.: 18/017,603

(22) PCT Filed: Jul. 21, 2021

(86) PCT No.: PCT/US2021/042667
§ 371 (c)(1),
(2) Date: Jan. 23, 2023

(87) PCT Pub. No.: WO2022/020536
PCT Pub. Date: Jan. 27, 2022

(65) Prior Publication Data

US 2023/0265744 A1 Aug. 24, 2023

Related U.S. Application Data

(60) Provisional application No. 63/054,645, filed on Jul. 21, 2020.

(51) Int. Cl.
*E21B 43/01* (2006.01)
*E02B 15/00* (2006.01)

(52) U.S. Cl.
CPC .... *E21B 43/0122* (2013.01); *E02B 2015/005* (2013.01)

(58) Field of Classification Search
CPC ..... E21B 43/0122; E02B 2015/005; E02B 15/04; E02B 15/045
See application file for complete search history.

(56) References Cited

U.S. PATENT DOCUMENTS 3,230,967 A 1/1966 Castro
3,245,539 A 4/1966 Earle
(Continued)

FOREIGN PATENT DOCUMENTS

CN 1139972 A 1/1997
CN 101523012 A 9/2009
(Continued)

OTHER PUBLICATIONS

Internation Search Report of PCT/US2012/023839 issued Feb. 11, 2013, 4 pages.
(Continued)

*Primary Examiner* — Carib A Oquendo
(74) *Attorney, Agent, or Firm* — Calderon Safran & Wright P.C.; Corinne Marie Pouliquen

(57) ABSTRACT

A containment unit for containing fluid leaks in an ambient liquid. The containment unit comprises a weighted base for being disposed around the fluid leak. The weighted base is positioned on top of one or more suction piles. Further, the containment unit comprises a curtain unit coupled to the weighted base. The curtain unit comprises a helical spring and facilitates containing the fluid leak in the ambient fluid. The containment unit further comprises a flotation unit coupled to the curtain unit. The containment unit also comprises thrust roller bearings to allow rotation of the curtain unit with respect to the weighted base and the flotation unit. The invention further discloses a containment system comprising multiple containment units as needed depending on the depth of ambient liquid and as a surface flotation unit comprising pumps, sensors and skimming units to allow for the fluid leaked to be transferred to a vessel.

19 Claims, 8 Drawing Sheets

(56) References Cited

U.S. PATENT DOCUMENTS

| | | | |
|---|---|---|---|
| 3,327,667 | A | 6/1967 | Manning |
| 3,339,512 | A | 9/1967 | Siegel |
| 3,389,559 | A | 6/1968 | Logan |
| 3,469,402 | A | 9/1969 | Lowd |
| 3,543,422 | A | 12/1970 | Plutchak |
| 3,548,605 | A | 12/1970 | Paull et al. |
| 3,561,220 | A | 2/1971 | Riester |
| 3,610,194 | A | 10/1971 | Siegel |
| 3,624,702 | A | 11/1971 | Meheen |
| 3,653,215 | A | 4/1972 | Crucet |
| 3,658,181 | A | 4/1972 | Blair |
| 3,664,136 | A | 5/1972 | Laval, Jr. et al. |
| 3,666,100 | A | 5/1972 | Madej |
| 3,667,605 | A | 6/1972 | Zielinski |
| 3,674,150 | A | 7/1972 | Lejeune |
| 3,681,923 | A | 8/1972 | Hyde |
| 3,698,198 | A | 10/1972 | Phelps |
| 3,710,582 | A | 1/1973 | Hills et al. |
| 3,724,662 | A | 4/1973 | Ortiz |
| 3,879,951 | A | 4/1975 | Mason |
| 3,981,154 | A | 9/1976 | Hix, Jr. |
| 4,047,390 | A | 9/1977 | Boyce, II |
| 4,212,329 | A | 7/1980 | Horton |
| 4,220,207 | A | 9/1980 | Allen |
| 4,229,297 | A | 10/1980 | Nohmi et al. |
| 4,231,873 | A | 11/1980 | Swigger |
| 4,283,159 | A | 8/1981 | Johnson et al. |
| 4,290,714 | A | 9/1981 | Strange |
| 4,293,239 | A | 10/1981 | Petty et al. |
| 4,298,295 | A | 11/1981 | Bozzo et al. |
| 4,318,442 | A | 3/1982 | Lunde et al. |
| 4,350,014 | A | 9/1982 | Sanchez et al. |
| 4,358,218 | A | 11/1982 | Graham |
| 4,358,219 | A | 11/1982 | Burns |
| 4,373,834 | A | 2/1983 | Grace |
| 4,382,716 | A | 5/1983 | Miller |
| 4,395,157 | A | 7/1983 | Cunningham |
| 4,402,632 | A | 9/1983 | Cook |
| 4,405,258 | A | 9/1983 | O'Rourke et al. |
| 4,416,565 | A | 11/1983 | Ostlund |
| 4,421,436 | A | 12/1983 | Burns |
| 4,449,850 | A | 5/1984 | Cessou et al. |
| 4,456,071 | A | 6/1984 | Milgram |
| 4,531,860 | A | 7/1985 | Barnett |
| 4,568,220 | A | 2/1986 | Hickey |
| 4,626,132 | A | 12/1986 | Allen |
| 4,728,224 | A | 3/1988 | Salama et al. |
| 4,944,872 | A | 7/1990 | Kantor |
| 5,050,680 | A | 9/1991 | Diehl et al. |
| 5,213,444 | A | 5/1993 | Henning |
| 5,284,213 | A | 2/1994 | Nobileau |
| 5,484,024 | A | 1/1996 | Ladd et al. |
| 5,582,252 | A | 12/1996 | Richmond et al. |
| 6,244,785 | B1 | 6/2001 | Richter et al. |
| 6,554,534 | B1 | 4/2003 | Butterfield |
| 6,592,299 | B1 | 7/2003 | Becker |
| 6,609,853 | B1 | 8/2003 | Guilmette |
| 7,721,611 | B2 | 5/2010 | Salama |
| 7,870,732 | B2 | 1/2011 | Kuo |
| 8,016,030 | B1 | 9/2011 | Prado Garcia |
| 8,173,012 | B1 | 5/2012 | Che |
| 8,297,361 | B1 | 10/2012 | Root |
| 8,517,632 | B2 | 8/2013 | Later |
| 8,523,482 | B1 | 9/2013 | Watson, Sr. |
| 9,309,640 | B2 | 4/2016 | Denning |
| 9,328,471 | B2 | 5/2016 | Splittstoesser |
| 9,476,411 | B2 | 10/2016 | Gaigler et al. |
| 9,506,211 | B2 | 11/2016 | Losnedal et al. |
| 10,400,410 | B2 | 9/2019 | Cook |
| 10,753,058 | B2 | 8/2020 | Cook |
| 2010/0032164 | A1 | 2/2010 | Bakke |
| 2010/0038324 | A1 | 2/2010 | Couch |
| 2010/0143038 | A1 | 6/2010 | Cobb |
| 2011/0031810 | A1 | 2/2011 | Bright |
| 2011/0274495 | A1 | 11/2011 | Estes |
| 2011/0274496 | A1 | 11/2011 | Dvorak |
| 2011/0293372 | A1 | 12/2011 | Later |
| 2011/0293377 | A1 | 12/2011 | Goulet et al. |
| 2011/0299930 | A1 | 12/2011 | Messina |
| 2011/0318106 | A1 | 12/2011 | Gateff et al. |
| 2011/0318107 | A1 | 12/2011 | Dighe |
| 2011/0318108 | A1 | 12/2011 | Wolinsky |
| 2012/0024384 | A1 | 2/2012 | Chaddick |
| 2012/0024533 | A1 | 2/2012 | Ivic |
| 2012/0024535 | A1 | 2/2012 | Lieske |
| 2012/0027517 | A1 | 2/2012 | Shifferaw |
| 2012/0045285 | A1 | 2/2012 | Hansen |
| 2012/0051841 | A1 | 3/2012 | Hatton et al. |
| 2012/0070231 | A1 | 3/2012 | Al-Sharif |
| 2012/0080194 | A1 | 4/2012 | Birdwell |
| 2012/0152560 | A1 | 6/2012 | O'Malley |
| 2012/0155964 | A1 | 6/2012 | Carter et al. |
| 2012/0251244 | A1 | 10/2012 | Toedtman |
| 2013/0046126 | A1 | 2/2013 | Varney et al. |
| 2013/0084136 | A1 | 4/2013 | Losnedal et al. |
| 2013/0108369 | A1 | 5/2013 | Splittstoesser |
| 2013/0195555 | A1 | 8/2013 | Kersten et al. |
| 2013/0236273 | A1 | 9/2013 | Heiler et al. |
| 2013/0279988 | A1 | 10/2013 | Al-Buraik |
| 2014/0356068 | A1 | 12/2014 | Andritsos et al. |
| 2014/0356069 | A1 | 12/2014 | Gateff et al. |
| 2015/0197906 | A1 | 7/2015 | Denning |
| 2016/0222618 | A1 | 8/2016 | Cook |
| 2016/0333674 | A1 | 11/2016 | Anderson et al. |
| 2017/0321524 | A1 | 11/2017 | Vu et al. |

FOREIGN PATENT DOCUMENTS

| | | |
|---|---|---|
| FR | 2853673 | 10/2004 |
| KR | 20140104821 A | 8/2014 |
| WO | WO1981001310 | 5/1981 |
| WO | WO1982001387 | 4/1982 |
| WO | WO1994017251 A1 | 8/1994 |
| WO | WO2004092006 | 10/2004 |
| WO | WO2011163239 | 12/2011 |
| WO | WO2012007389 | 1/2012 |
| WO | WO2012020322 | 2/2012 |
| WO | WO2012022277 | 2/2012 |
| WO | WO2012062264 | 5/2012 |

OTHER PUBLICATIONS

Internation Search Report & Written Opinion of PCT/US2021/042667 issued Oct. 26, 2021, 6 pages.

CONTAINMENT UNIT, CONTAINMENT SYSTEM AND METHOD FOR CONTAINING FLUID LEAKS

CROSS REFERENCE TO RELATED APPLICATIONS

This application is a non-provisional application that claims priority to Provisional Application Ser. No. 63/054,645 filed Jul. 21, 2020, the disclosure of which is incorporated herein by reference.

FIELD OF THE DISCLOSURE

The invention generally relates to oil leaks under water (or similar situations such as gas leaks on land). More specifically, the invention relates to a containment unit for containing and recovering spilled oil, quickly and efficiently, and thereby minimizing loss of oil, and substantially reducing the resulting environmental impact.

BACKGROUND OF THE DISCLOSURE

Currently, salvaging oil from deep sea leaks and minimizing their associated side effects have been of great concern. Such leaks waste valuable quantities of oil and/or gas, and the oil causes huge environmental problems, to the sea, beaches, wildlife, etc. Further, monetary expense and cost to the environment of these spills are staggering. Such leaks cause hydrocarbons to escape into an ambient atmosphere or open waters, causing pollution. Further, great quantities of oil wastage are involved with these spills. For example, in the 1979 tragedy of the Mexican oil well leak in the Bay of Campeche, it was reported that the leak was spewing out more than 10,000 barrels of oil daily, and that in less than three months it had dumped over 2,000,000 barrels of oil into the gulf.

In another example, the Deepwater Horizon oil spill spilled oil in the Gulf of Mexico for three months in 2010. Such impact of the spill continued long after the well was capped. It remains the largest accidental marine oil spill in the history of the petroleum industry. On July 15, the leak was stopped by capping the gushing wellhead, but not until after it had released about 4.9 million barrels or 205.8 million gallons of crude oil. It was estimated that 53,000 barrels per day (8,400 m3/d) were escaping from the well just before it was capped. It is believed that the daily flow rate diminished over time, starting at about 62,000 barrels per day (9,900 m3/d) and decreasing as the reservoir of hydrocarbons feeding the gusher was gradually depleted. On September 19, the relief well process was successfully completed, and the federal government declared the well 'effectively dead.' However, the spill continues to cause extensive damage to marine and wildlife habitats as well as the Gulf's fishing and tourism industries.

In late November 2010, 4,200 square miles (11,000 km2) of the Gulf were re-closed to shrimping after tar balls were found in shrimpers' nets. The total amount of Louisiana shoreline impacted by oil grew from 287 in July to 320 miles (510 km) in late November. In January 2011, eight months after the explosion, an oil spill commissioner reported that tar balls continue to wash up, oil sheen trails are seen in the wake of fishing boats, wetlands marsh grass remains fouled and dying, and that crude oil lies offshore in deep water and fine silts and sands onshore.

Typically, there are one or more systems where a unit is dropped over a damaged or broken riser in a closed position, the unit is released and stabilized in sections until the surface is reached and a containment unit is completely erected. However, there is a need for an improved method and system for containing and recovering spilled oil, quickly, efficiently, and conveniently, and thereby minimizing loss of oil, and protecting the environment.

SUMMARY OF THE DISCLOSURE

A containment unit for containing a fluid leak comprising a weighted base for being disposed around the fluid leak. The weighted base is positioned on top of one or more suction piles. In addition, the one or more suction piles are placed in a pre-set location on the seafloor, with guide wires, cables, or durable rope to a surface, to place the containment unit in correct orientation and position. The weighted base is positioned on the top of one or more suction piles, using remotely operated vehicles (ROV) or divers. The weighted base surrounds a blowout preventer (BOP) that is coupled to a marine riser. Further, the containment unit comprises a curtain unit coupled to the weighted base. The curtain unit comprises strong and lightweight material. The curtain unit facilitates containing the fluid leak in the ambient fluid. The curtain unit comprises a helical spring, a curtain fabric, and a curtain connection ring. The curtain connection ring connects a top part of the curtain unit to a bottom part of a flotation unit. The flotation unit is coupled to the curtain unit. The flotation unit comprising one or more gas cylinders for injecting air into the flotation unit to lift the flotation unit towards a surface of the ambient fluid. Further, the flotation unit comprises a winch positioned inside the flotation unit, which facilitates stretching the curtain unit. The one or more cylinders and the winch controls an ascent speed of the flotation unit towards the surface of the ambient fluid. The weighted base also includes a winch that facilitates stretching and lifting of the curtain unit.

In one embodiment, the curtain unit comprises a primary curtain housing and a secondary curtain housing. The primary curtain housing comprises a primary curtain and the secondary curtain housing comprises a secondary curtain. Further, the secondary curtain is lifted using another winch. Further, the primary curtain and the secondary curtain are flexible.

In one embodiment, one or more containment units may be coupled together depending on the depth of the ambient fluid at a drilling site. In another embodiment, the containment unit further comprises a surface flotation unit comprising one or more sensors associated with one or more pumps for monitoring the flow of leaked fluids being removed. The containment unit also comprises guide rings and guide wires or cables. Further, the guide rings and the guide wires or cables guide the erection of the containment unit and any subsequent units.

In one embodiment, the containment unit is anchored and caps a broken marine riser above the seabed. Such a containment unit contains the leaks of fluid into the ambient fluid. Further, such a containment unit facilitates a quick response deep sea containment structure. The containment unit also provides a safe solution to containment and control in case of an oil spill. In addition, the containment unit facilitates a cost effective method to contain oil spills in any global subsea location. Further, the containment unit facilitates the ability to collect and produce the oil as it is pumped from a column of oil at the surface via the surface flotation unit thus minimizing any impact on the environment.

In another embodiment, the containment unit comprises a weighted base for being disposed around the fluid leak, a curtain unit coupled to the weighted base, wherein the curtain unit comprises a helical spring and facilitates containing the fluid leak in the containment unit, a flotation unit coupled to the curtain unit and an upper thrust roller bearing mounted on the flotation unit and a lower thrust roller bearing mounted on the weighted base, wherein the upper and lower thrust roller bearings facilitate rotation of the curtain unit with respect to the flotation unit and the weighted base.

In another embodiment, a containment system comprises the containment unit described herein, wherein the weighted base of the containment unit surrounds a blowout preventer (BOP) that is coupled to a marine riser.

In another embodiment, a method is provided for containing fluid leaks in an ambient liquid using the containment unit of the invention, the method comprising the steps of installing one or more suction piles on a seabed around a blowout preventer; deploying the containment unit moored to the one or more suction piles by releasing the flotation unit; anchoring the flotation unit; dropping and deploying subsequent containment units from a vessel until a surface of ambient liquid is reached; coupling a surface flotation unit to the flotation unit on the surface; and collecting the leaked fluid.

As such, those skilled in the art will appreciate that the conception upon which this disclosure is based may be readily utilized as a basis for the designing of other structures, methods, and systems for carrying out several purposes of the present invention. It is important, therefore, that equivalent constructions insofar as they do not depart from the spirit and scope of the present invention, are included in the present invention.

For a better understanding of the invention, its operating advantages and the aims attained by its uses, references to the accompanying drawings and descriptive matter that illustrate preferred embodiments of the invention should be used.

These and other examples of the invention will be described in further detail below.

BRIEF DESCRIPTION OF THE DRAWINGS

The accompanying drawings illustrate various embodiments of systems, methods, and embodiments of various aspects of the disclosure. Any person of ordinary skill in the art will appreciate that the illustrated element boundaries (e.g., boxes, groups of boxes, or other shapes) in the figures represent one example of the various boundaries representative of the disclosed invention. It may be that in some examples one element may be designed as multiple elements or that multiple elements may be designed as one element. In other examples, an element shown as an internal component of one element may be implemented as an external component in another, and vice versa. Furthermore, elements may not be drawn to scale. Non-limiting and non-exhaustive descriptions of the present disclosure are described with reference to the following drawings. The components in the figures are not necessarily to scale, emphasis instead being placed upon the illustrated principles.

Various embodiments will hereinafter be described in accordance with the appended drawings, which are provided to illustrate and not to limit the scope of the disclosure in any manner, wherein similar designations denote similar elements, and in which.

DETAILED DESCRIPTION

Figure 1:
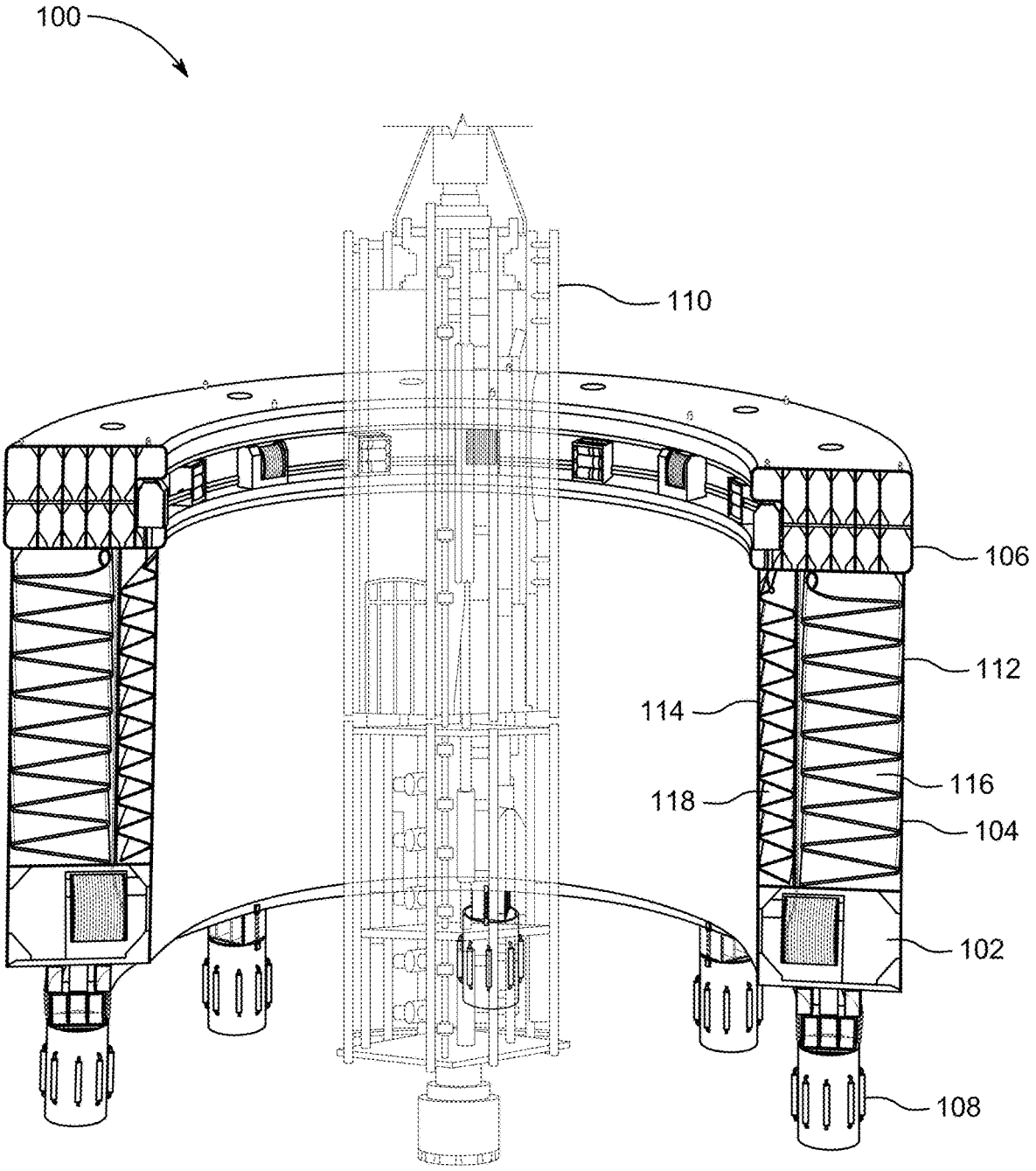
FIG. 1 illustrates a sectional view showing a containment unit 100, according to an embodiment of the disclosure.

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Some embodiments of this disclosure, illustrating all its features, will now be discussed in detail. The words 'comprising,' 'having,' 'containing,' and 'including,' and other forms thereof, are intended to be equivalent in meaning and be open-ended in that an item or items following any one of these words is not meant to be an exhaustive listing of such item or items, or meant to be limited to only the listed item or items.

It must also be noted that as used herein and in the appended claims, the singular forms 'a,' 'an,' and 'the' include plural references unless the context dictates otherwise. Although any number of systems and methods similar or equivalent to those described herein can be used in the practice or testing of embodiments of the present disclosure, the preferred systems, and methods are now described.

This description of exemplary embodiments is intended to be read in connection with the accompanying drawings, which are to be considered part of the entire written description. In the description, relative terms should be construed to refer to the orientation as then described or as shown in the drawing figure under discussion and to the relative orientation. These relative terms are for convenience of description and normally are not intended to require a particular orientation. Terms concerning attachments, coupling and the like, refer to a relationship wherein structures are secured or attached to one another either directly or indirectly through intervening structures, as well as both movable or rigid attachments or relationships, unless expressly described otherwise. Additionally, the word 'a' as used in the claims means 'at least one'.

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatus and methods described herein may be used alone or in combination with other systems and methods.

Embodiments of the present disclosure will be described more fully hereinafter with reference to the accompanying drawings in which like numerals represent like elements throughout the several figures, and in which example embodiments are shown. Embodiments of the present disclosure may, however, be embodied in alternative forms and should not be construed as being limited to the embodiments set forth herein. The examples set forth herein are non-limiting examples and are merely examples among other possible examples.

FIG. 1 illustrates a perspective view of a containment unit 100, in accordance with an embodiment of the disclosure. FIG. 1 is explained in conjunction with FIGS. 2 & 3.

Figure 2:
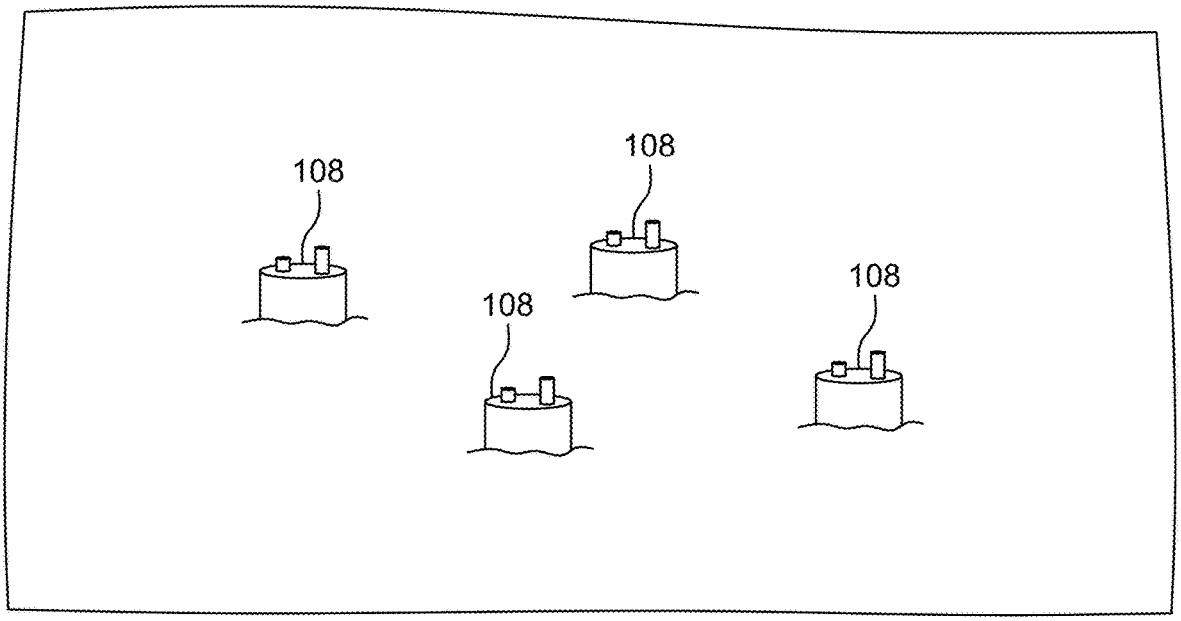
FIG. 2 illustrates a perspective view showing one or more suction piles 108, according to an embodiment of the disclosure.
Figure 3:
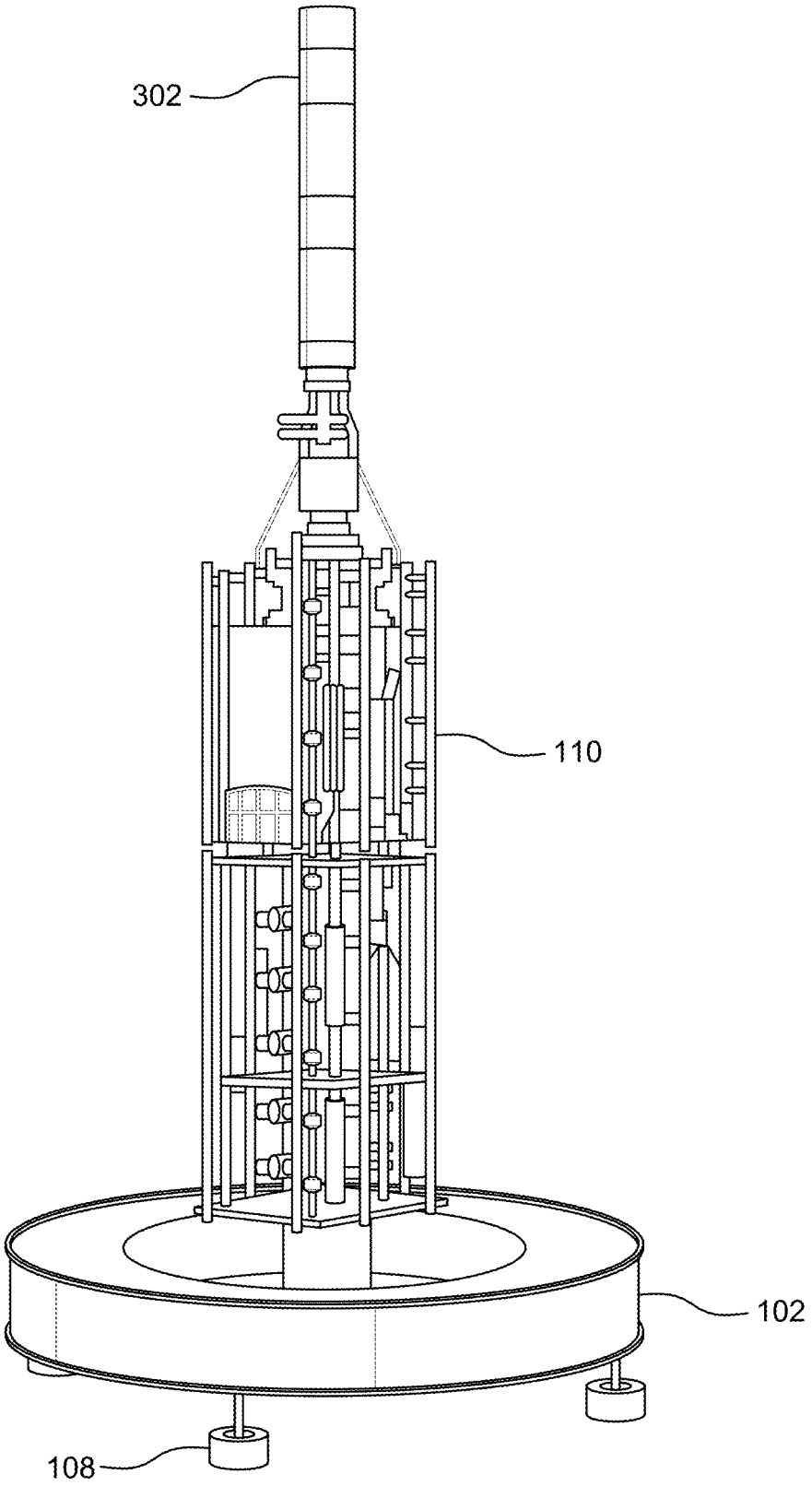
FIG. 3 illustrates a perspective view showing a blowout preventer (BOP) 110 along with the containment unit, according to an embodiment of the disclosure.

The containment unit 100 may comprise a weighted base 102, a curtain unit 104, and a flotation unit 106. In one embodiment, the weighted base 102 may be disposed around a blowout preventer (BOP) 110. Further, the weighted base 102 may be positioned on top of one or more suction piles 108. In one embodiment, the one or more suction piles 108 may be fixed on the seabed. Further, the one or more suction piles 108 may form a fixed platform anchor in the form of an open bottomed tube embedded in the sediment and sealed at the top while in use so those lifting forces generate a pressure differential that holds the one or more suction piles 108 down. In one embodiment, the one or more suction piles 108 may be lowered to the seabed and installed as mooring for the containment unit 100, prior to drilling rig's arrival and spud. Further, the one or more suction piles 108 may be installed first, as shown in FIG. 2, before installing the BOP 110 and riser 302 as shown in FIG. 3. Further, the BOP 110 may be a conventional BOP, as used in state-of-the-art technologies. More specifically, the BOP 110 may be a specialized valve or similar mechanical device, used to seal, control, and monitor oil and gas wells to prevent blowouts, the uncontrolled release of crude oil or natural gas from a well. They are usually installed in stacks of other valves. It can be noted that the one or more suction piles 108 may be anchored to the seabed floor and used to moore the containment unit 100. In one exemplary embodiment, the containment unit 100 is positioned on at least 4 suction piles, as shown in FIG. 2. In another embodiment, the containment unit 100 is positioned on additional suction piles.

Further, the one or more suction piles 108 may have a pre-defined length and diameter. In one embodiment, the length and diameter of the one or more suction piles 108 may be based on the dimensions of the containment unit 100. Further, the one or more suction piles 108 may facilitate a number of advantages over conventional offshore foundations, mainly being quicker to install than deep foundation piles and being easier to remove during decommissioning. Suction piles are used effectively as mooring anchors and anchoring points in deep water. The suction piles (also called suction caissons or suction anchors) are long steel cylinders topped with a pile top or cap. The cap comprises valves to assist with embedment as well as connections that differ depending on the use of the pile.

The suction piles are deployed from an offshore construction vessel or from an anchor handling vessel by being lowered to the seabed. Large steel cylinders with an open bottom, the suction pile penetrates up to 60% of its length under its own weight, depending on soil conditions and the pile properties. The remainder of embedment is achieved through suction: a remote-operated vehicle (ROV) pumps water out of the top suction port after sealing pile top valves. Pile top and ROV instrumentation contribute to a precise installation. The pile can also be retrieved by reversing the installation process, applying an overpressure inside the caisson.

Figure 4:
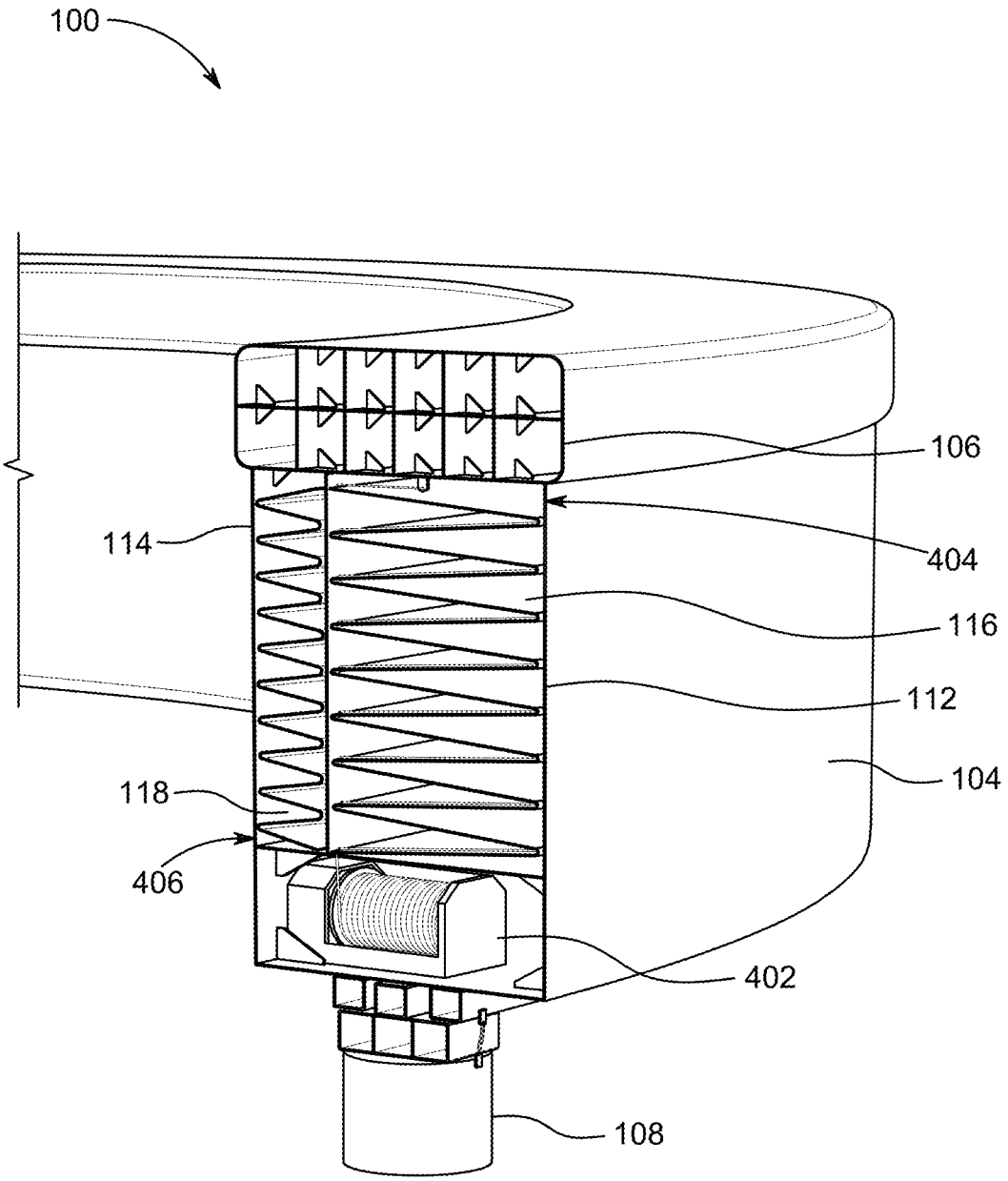
FIG. 4 illustrates a sectional view showing the containment unit 100, according to an embodiment of the disclosure.

In one embodiment, the curtain unit 104 may be coupled to the weighted base 102. It can be noted that the curtain unit 104 may facilitate containing the fluid leak in an ambient fluid. In one embodiment, the ambient fluid corresponds to sea water. Further, the curtain unit 104 may comprise a primary curtain housing 112 and a secondary curtain housing 114. The primary curtain housing 112 may comprise a primary curtain 116 and the secondary curtain housing 114 may comprise a secondary curtain 118 as seen in FIGS. 1 and 4. Such use of the primary curtain 116 and the secondary curtain 118 may provide a containing facility to the containment unit 100, to contain any fluid leaks inside the containment unit 100.

In one embodiment, the flotation unit 106 may be coupled to the curtain unit 104. Further, the flotation unit 106 may comprise one or more gas cylinders 120. In one embodiment, the one or more gas cylinders 120 may facilitate injecting air into the flotation unit 106, to lift the flotation unit 106 towards a surface of ambient fluid. The flotation unit 106 may also comprise vent holes 122 to release air. It can be noted that the flotation unit 106 may lift towards the surface of the ambient fluid, due to buoyancy of the flotation unit 106.

Use of the of containment unit of the invention 100 reduces the effects of vortex-induced vibrations (VIV). When current flows past a cylindrical object such as a riser, tendon, jumper, or horizontal pipeline span, it creates a VIV. The friction of the cylinder surface may cause boundary layers to form on each side of the cylinder-shaped object. Retardation of the flow due to the friction ultimately causes the boundary layers to separate from the cylinder. It can be noted that the friction of the cylinder surface of the containment unit 100 may be reduced by allowing the curtain to fluctuate with the currents due to the helical spring (as further described herein) as well as the ability of the curtain to rotate with respect to the weighted base and the flotation unit (also as further described herein).

In one embodiment, as shown in FIG. 3, the BOP 110 may be a large, specialized unit that may be used to prevent an oil spill from occurring. Further, the BOP 110 may work like a valve to close an oil well. Further, the BOP 110 may be similar to a plumber closing a valve in a pipe, and proven to be highly effective in ensuring well safety. In one embodiment, the BOP 110 may be coupled to a marine riser 302. Further, the marine riser 302 may be a cylindrical conduit to transfer crude oil from the subsea wellhead to an offshore facility. Further, a combination of a variety of environmental loads that arise from waves, current, and those arising from the impact of vessels may result in the development of extreme stresses. In one embodiment, the marine riser 302 may be a temporary extension of a wellbore to the surface. Further, the marine riser 302 may have a pre-defined height and diameter. In one embodiment, the marine riser 302 may be selected based on the dimensions of the BOP 110. Further, the BOP 110 and the marine riser 302 may be installed inside the weighted base 102 as seen in FIG. 3. It can be noted that the friction of the cylinder surface of the containment unit 100 may be reduced by allowing the curtain to fluctuate with the currents due to the helical spring (as further described herein) as well as the ability of the curtain to rotate with respect to the weighted base and the flotation unit.

FIG. 4 illustrates a sectional view of the containment unit 100. In one embodiment, the containment unit 100 may comprise the one or more suction piles 108 and the curtain unit 104. Further, the curtain unit 104 comprises the primary curtain housing 112 and the secondary curtain housing 114. The primary curtain housing 112 may comprise the primary curtain 116 and the secondary curtain housing 114 comprises the secondary curtain 118. Further, the containment unit 100 may comprise the flotation unit 106. In one embodiment, the flotation unit 106 may be a flotation ring. In one embodiment, the primary curtain 116 and the secondary curtain 118 may be pinned in place until the containment unit 100 is deployed.

In one embodiment, when the flotation unit 106 is released, the curtain unit 104 may get stretched. Further, the curtain unit 104 may consequently stretch the primary curtain housing 112 and the secondary curtain housing 114. In one embodiment, the primary curtain 116 may be stretched alone. In another embodiment, the secondary curtain 118 may be a backup curtain and may only function when the primary curtain 116 is non-functional or damaged. Further, the primary curtain 116 or the secondary curtain 118 may rotate on pre-defined tracks (not shown) by means of the thrust roller bearings. In one embodiment, the tracks may be inside the primary curtain housing 112 or the secondary curtain housing 114. Further, the flotation unit 106 may rise to a predefined height, when deployed. In one exemplary embodiment, the flotation unit 106 rises to 1,000 feet up when deployed.

Further, the flotation unit 106 may comprise a first winch 402. In one embodiment, the first winch 402 may be a hydraulic winch. In one embodiment, the first winch 402 may assist in stretching the primary curtain 116 or the secondary curtain 118. Further, the first winch 402 may use a fluid in a confined space. It can be noted that, the first winch 402 may use a pump to create a pressure differential. Further, the pressure differential may involve having a low-pressure fluid stored in a reservoir. Further, the pressure differential may become supported inside of the pump, which moves to the driven component and back to the reservoir.

Further, the containment unit 100 may comprise an upper thrust roller bearing 404 and a lower thrust roller bearing 406. The upper thrust roller bearing 404 may allow the primary curtain 116 or the secondary curtain 118 to rotate on the track. Further, the upper thrust roller bearing 404 may be mounted on the flotation unit 106, wherein the upper thrust roller bearing 404 facilitates rotation of the curtain unit 104 with respect to the flotation unit 106. In one embodiment, the upper thrust roller bearing 404 may be referred as a thrust ring bearing. The lower thrust roller bearing 406 may be mounted in the weighted base 102 to allow the primary curtain 116 or secondary curtain 118 to rotate with respect to the weighted base 102.

In one embodiment, the upper thrust roller bearing 404 may be associated with hydraulic locking pins, which may be retracted to allow the primary curtain 116 or the secondary curtain 118 to rotate freely around their respective axis. The rotation of the primary curtain 116 or the secondary curtain 118 may dissipate water current energy. In an exemplary embodiment, a plurality of containment units 100 may be connected together depending on the depth of the ambient fluid. In one exemplary embodiment, in 5,500 feet of seawater with 5 containment units may be deployed, thrust roller bearings may be allowed to rotate in any direct that the water current would be flowing in. Such use of thrust roller bearings may remove a large unnecessary loading from the total structure system.

In one embodiment, the primary curtain 116 may comprise at least one helical spring, a fabric, and a curtain connection ring. The curtain connection ring may connect a top section of the curtain to a bottom of the flotation unit 106. Further, the at least one helical spring may be embedded in the curtain fabric and compressed. It can be noted that the compression of the helical spring may facilitate the curtain to be deployed upon actuation. In one embodiment, the at least one helical spring may be made of a carbon composite material. Further, the composite may be wrapped and cast around a mandrel. Further, the composite may take on a curled shape of the mandrel, as the composite hardens. Further, the composite may be cooled and sealed into a curled shape. The at least one helical spring may be designed to return to a rested position after all loads are removed. Further, internal dimensions of the at least one helical spring may remain constant in the rest position or when the containment unit 100 is fully deployed.

In another embodiment, the secondary curtain 118 may comprise at least one helical spring, a fabric, and a curtain connection ring. The curtain connection ring may connect a top section of the curtain to a bottom of the flotation unit 106. In one embodiment, the curtain connection ring may connect a bottom part of the curtains 116, 118 to the lower thrust roller bearing 406. In one embodiment, the curtain connection ring may connect a top part of the curtains 116, 118 to the upper thrust roller bearing 404. Further, the at least one helical spring may be embedded in the curtain fabric and compressed. It can be noted that the compression of the helical spring may facilitate the curtain deployment upon actuation. In one embodiment, the helical spring may perform like a helical stake that is relatively bluff to an incoming flow and produces early separation of the incoming flow, which is associated with a higher drag. Further, helical stake may be dependent on parameters such as Reynolds number, surface roughness, or presence of marine growth, etc. Further, the drag coefficient for the helical stake may vary from about 1.3 to 2.0 for deepest water tubulars. Further, the helical stake may be effective at reducing VIV for a wide range of applications. In one embodiment, to increase or decrease the drag coefficient from the helical spring, a flat flange width of the helical spring may be increased or decreased in width to help the drag. In one embodiment, the primary curtain 116 and the secondary curtain 118 may be manufactured to accommodate installation of the helical stake. In one embodiment, helical strakes may be effective when they break up the correlation of vortices along a subsea cylinder and produce random alternating forces along the cylinder length. It can be noted that deepwater cylinders may be made for shorter cylinders, such as spar production platforms, where considerations such as drag and the need for shorter correlation lengths (due to the limited length of the structure) have driven helical strake designs closer to the geometries of tradition helical strakes for wind applications. Further, the helical stake may be incorporated into the primary curtain 116 and the secondary curtain 118, during manufacturing in shading off some of subsea current energy from around the primary curtain 116 and the secondary curtain 118. Further, the primary curtain 116 and the secondary curtain 118 may be woven protac stress absorbing membrane comprising a stress absorbing geotextile fabric that is combined with a rubberized bitumen to produce a composite membrane that bonds tenaciously to clean and dry surfaces.

Further, based on the Reynolds number, different flow patterns may be encountered and the spring pitch may be designed to shed eddy currents. Further, the containment unit 100 may help with vortex shedding by rotating into the current, as the containment unit 100 settles on the thrust roller bearing frame. In addition, roughness of a curtain material may increase the coefficient of friction across a curtain surface. In one embodiment, the Reynolds number may be used to predict flow patterns in different fluid flow situations. At low Reynolds numbers, flows tend to be dominated by laminar (sheet-like) flow, while at high Reynolds number turbulence results from differences in the fluid's speed and direction, which may sometimes intersect or even move counter to the overall direction of the flow (eddy currents). The eddy currents may begin to churn the flow, using up energy in the process, which for liquids increases the chances of cavitation. Further, the Reynolds number has wide applications, ranging from liquid flow in a pipe to the passage of air over an aircraft wing. The Reynolds number may be used to predict the transition from laminar to turbulent flow, and is used in the scaling of similar but different-sized flow situations, such as between an aircraft model in a wind tunnel and the full size version. The predictions of the onset of turbulence and the ability to calculate scaling effects may be used to help predict fluid behavior on a larger scale, such as in local or global air or water movement and thereby the associated meteorological and climatological effects. In one exemplary embodiment, a vortex is formed around cylinders and spheres for any fluid, cylinder size and fluid speed, provided that it has a Reynolds number ranging from 40 to 1,000.

Figure 5C:
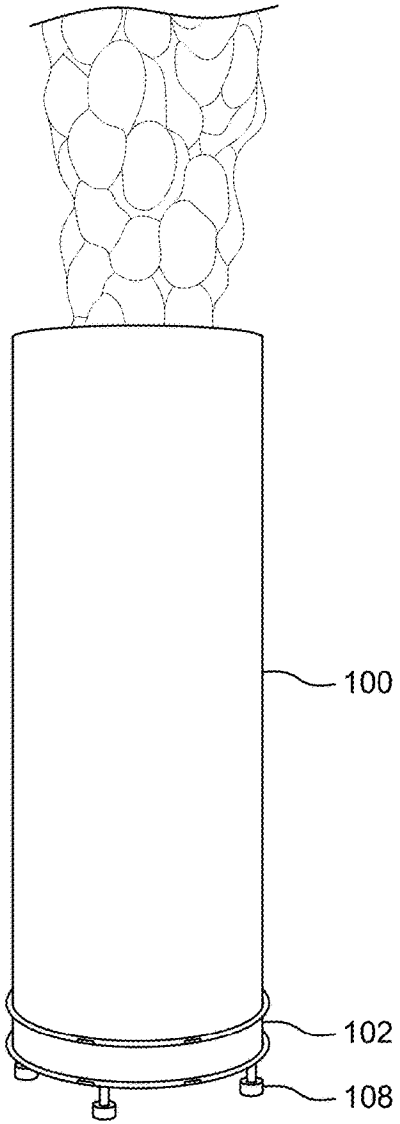
FIGS. 5A, 5B, and 5C illustrate a perspective view showing the containment unit 100 in compressed positon, partially deployed position, and fully deployed position, according to an embodiment of the disclosure.
Figure 5B:
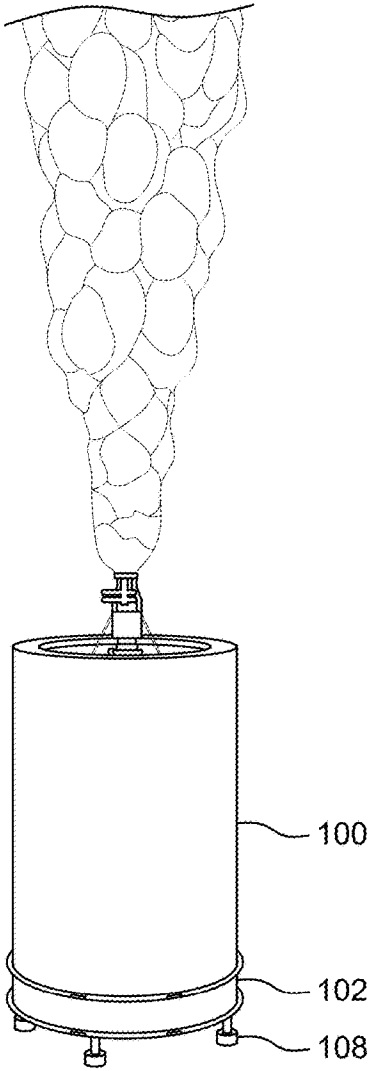
Figure 5A:
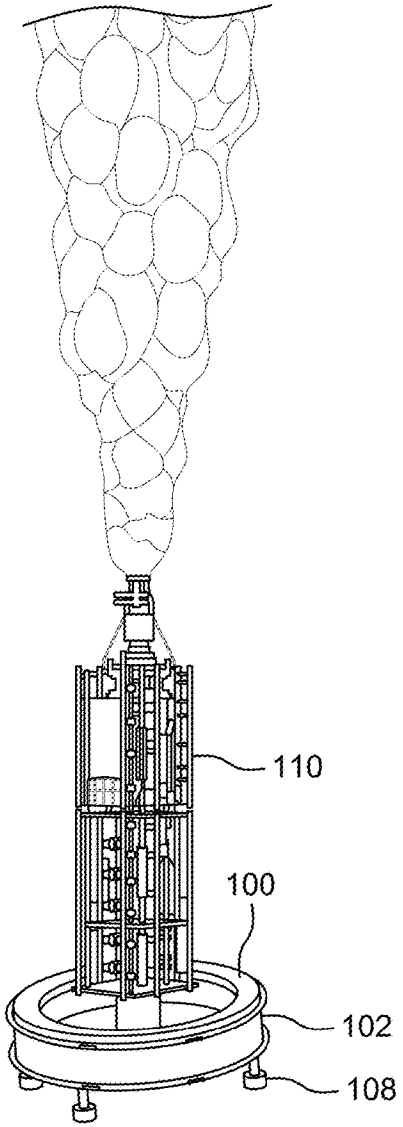

In one embodiment, FIG. 5A illustrates a drawing showing the containment unit 100 in a compressed position. Further, when there is a spill resulting into a broken marine riser 302, the marine riser 302 may be cut and removed and then the containment unit 100 may be deployed. In another embodiment, FIG. 5B illustrates the containment unit 100 partially deployed over a broken marine riser 302. In another embodiment, FIG. 5C illustrates the containment unit 100 in a fully deployed position. It can be noted that the weighted base 102 may be open to sea water to prevent freezing. Further, the curtain unit 104 may be extended to 1,000-foot increments above the sea floor. The first containment unit 100 is preinstalled and erected over a BOP and riser. In the event of a leak, the first containment unit is erected, and subsequent containment units 100 are lowered from a vessel using guide wires fed through guide rings.

Figure 6:
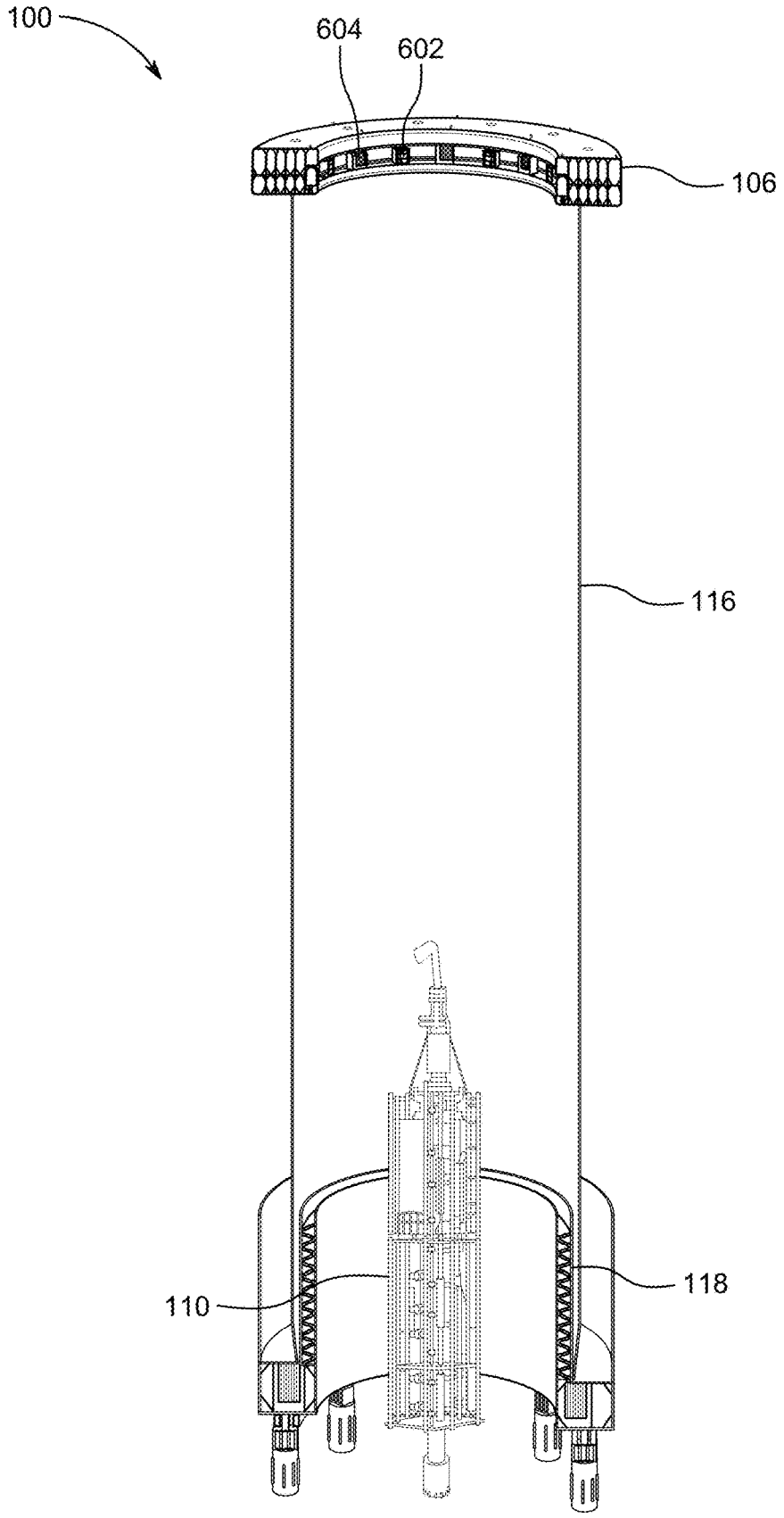
FIG. 6 illustrates a sectional view showing the containment unit 100 in an expanded position, according to an embodiment of the disclosure.

In one embodiment, FIG. 6 illustrates a drawing of the containment unit 100 when fully deployed. It can be noted that the curtain unit 104 may be raised by the flotation unit 106. It can be noted that the flotation unit 106 may comprise a plurality of gas cylinders 602. Further, the plurality of gas cylinders 602 may be used to blow air into the flotation unit 106 to create buoyancy. In one embodiment, the containment unit 100 may comprise at least one second winch 604, which may facilitate stretching the secondary curtain 118. In one embodiment, the at least one second winch 604 may lift the secondary curtain 118. Further, the one or more gas cylinders 602 and the second winch 604 may control an ascent speed of the flotation unit 106 towards the surface of the ambient fluid, when the secondary curtain 118 is in operation.

Figure 7:
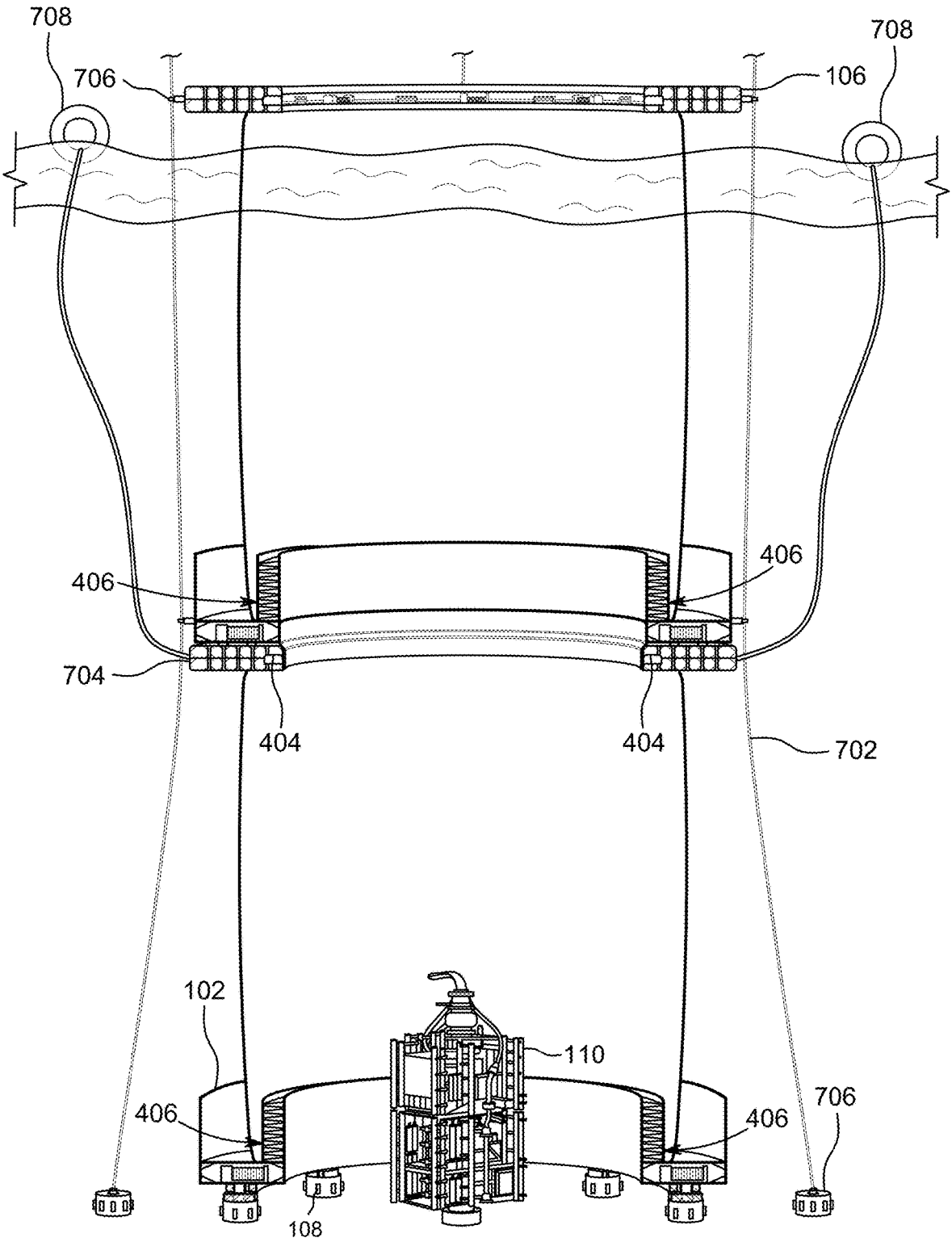
FIG. 7 illustrates a detailed diagram showing the containment unit 100 in an expanded position, according to an embodiment of the disclosure.

Further, FIG. 7 illustrates a detailed drawing of the containment system in an expanded position. It can be noted that a first set of the one or more suction piles 108 moore the containment unit 100. Further, a second set of one or more suction piles 108 may be used to moore guide wires or cables 702. It can be noted that the guide wires or cables 702 run through guide rings 704. Further, the guide rings 704 and guide wires or cables 702 may facilitate an erection of the containment unit 100. In one embodiment, the curtain unit 104 may rotate with respect to the weighted base 102 with the help of the lower thrust roller bearing 406. The curtain unit 104 may rotate with respect to the flotation unit 106 with the help of the upper thrust bearing 404. Further, the guide wires or cables 702 may be anchored to a base using a guide wire suction pile 706. Further, the guide wire suction pile 706 may be placed in a prearranged location on the seafloor, with guide wires or cables 702 to the surface. The use of the guide wire suction pile 706 may facilitate multiple containment units to be placed in a correct orientation to assemble a containment system.

Figure 8:
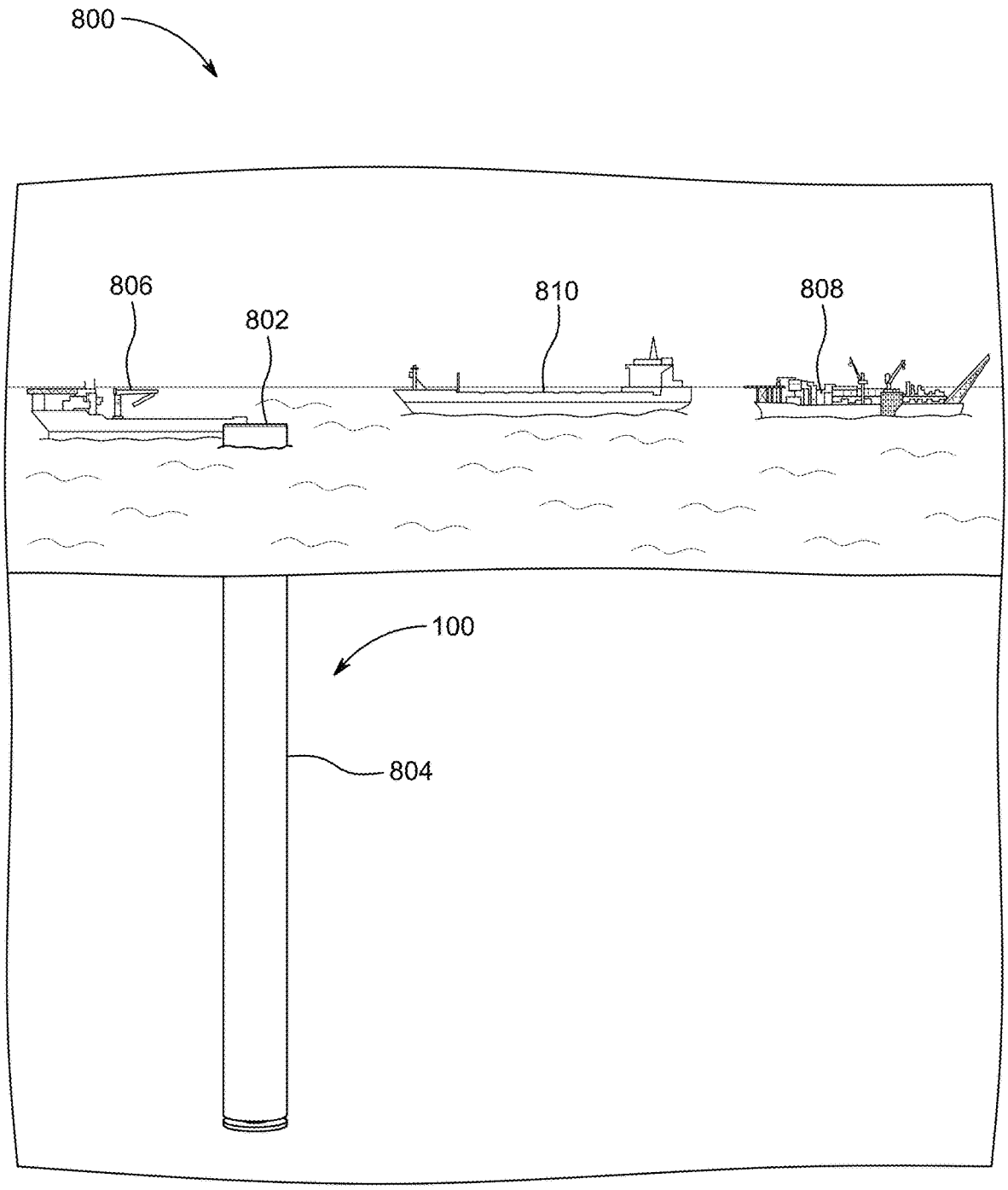
FIG. 8 illustrates sectional view showing the containment unit 100 in a fully deployed mode, according to an embodiment of the disclosure.

In one embodiment, as seabed waves pick up the flotation unit 106, the first winch 402 and the second winch 604 may payout. Further, as the waves lower the flotation unit 106, the first winch 402 and the second winch 604 may pay in. Such action of the first winch 402 and the second winch 604 may keep the primary curtain 116 or the secondary curtain 118 in tension. Further, the first winch 402 and the second winch 604 may adjust their speed of pay out or pay in for different wave lengths and heights. In one embodiment, a dynamic positioning (DP) support vessel may pick on pick up buoys 708 and connect the DP support vessel towing winch wire to the containment unit 100. In one embodiment, the pick up buoys 708 may be connected to pad eyes of the containment unit 100. Further, the DP support vessel may hold tension on containment unit 100 to ensure that the containment unit 100 stays vertical. In one embodiment, when fully deployed, the containment system may have a lower portion and an upper portion, which may be of different lengths. In one embodiment, the upper portion may be referred to as a surface flotation containment unit 802 as seen in FIG. 8. In one example embodiment, each containment unit 100 of the containment system has a length of 1,000 feet and the upper portion of the surface flotation containment unit 802 has a length of 200 feet.

FIG. 8 illustrates an exemplary embodiment 800 showing the containment unit 100 in a fully deployed mode. In one embodiment, the containment unit 100 may comprise a surface flotation containment unit 802 and a surface base unit 804. In one embodiment, the surface flotation unit 802 and the curtain unit 104 may be fully or partially detached, to de-couple the movements at the water surface (waves) from the movements below (currents). It can be noted that such de-coupling may be typical in riser systems. Further, the surface flotation unit 802 may comprise one or more sensors (not shown) associated with one or more pumps (not shown) for monitoring the flow of leaked fluids being removed. The pumps may be either self-floating or contained within a separate top structure, to transport oil from inside a containment zone to waiting vessels. Further, the one or more sensors may be placed at the inlet and outlet of the one or more pumps to monitor the flow of oil being removed. In another embodiment, one or more sensors may be placed at a bottom of the containment unit 100, to detect oil and ensure that no oil is escaping underneath. Further, the one or more sensors may measure the depth of contained oil to estimate a total volume of oil.

In one embodiment, the containment unit 100 may be deployed from the seabed and subsequent containment units may be dropped down from a vessel 806 from the water surface. Further, the vessel 806 may hold a top part of surface flotation containment unit 802. In one embodiment, a field support vessel 808 may assist the vessel 806. In an exemplary embodiment, the subsequent containment units 100 may be dropped down from the vessel 806 in a compressed position. Further, when the containment unit 100 is attached to an another containment unit 100, the curtain unit 104 may be released. In one embodiment, a shuttle tanker 810 may be used for transportation of oil from an offshore oil field as an alternative to constructing oil pipelines.

Further, when deployed, the containment unit 100 may be lifted towards the surface to allow access to the BOP 110. In one embodiment, a top portion of the containment unit 100 may be held by a vessel, using a low wire. Further, the containment unit 100 may be installed by divers or using remotely operated vehicles (ROVs). In one example embodiment, the containment unit 100 is installed using 3 ROVs, wherein a third one is for backup. Further, once all components of the containment unit 100 are in position, operations commence. In the event of an incident, the curtain unit 104 is raised by injecting air into the flotation unit 106 to extend the flotation unit 106 to a maximum height, at which time a subsequent containment unit will be deployed in the same fashion, based on water depth.

In one embodiment, the containment unit 100 may be used for containing fluid leaks by installing one or more suction piles 108 on a seabed. Further, the one or more suction piles 108 may assist in mooring and deploying the weighted base 102 of the containment unit 100. Further, the flotation unit 106 may be coupled to the weighted base 102. Further, the curtain unit 104 may be coupled to the weighted base 102 and the flotation unit 106, sequentially until a surface of the sea is reached. Further, the flotation unit 106 and the curtain unit 104 may be anchored before releasing a subsequent curtain unit 104. Further, subsequent containments units may be dropped from a vessel and the subsequent containment units may be deployed. Such use of multiple containment units may be used to contain fluid leaks in a deeper area. In one embodiment, the one or more gas cylinders 602 may be used for injecting air into the flotation unit 106 to lift the flotation unit 106 towards a surface of the ambient fluid. Further, the first winch 402 may be positioned inside the flotation unit 106. Further, the first winch 402 may facilitate stretching the curtain unit 104. Further, the one or more pumps and the first winch 402 may control an ascent speed of the flotation unit 106 towards the surface of the ambient fluid.

The foregoing description of the exemplary embodiments of the invention has been presented for the purpose of illustration. It is not intended to be exhaustive or to limit the invention to the precise forms disclosed. Obvious modifications or variations are possible in light of the above teachings. The embodiments disclosed hereinabove were chosen in order to best illustrate the principles of the invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the invention be defined by the claims appended thereto.

What is claimed is:

1. A containment unit for containing a fluid leak in an ambient fluid, the containment unit comprising:

a weighted base for being disposed around the fluid leak;

a curtain unit coupled to the weighted base, wherein the curtain unit comprises a helical spring and facilitates containing the fluid leak in the containment unit;

a flotation unit coupled to the curtain unit; and an upper thrust roller bearing mounted on the flotation unit and a lower thrust roller bearing mounted on the weighted base, wherein the upper and lower thrust roller bearings facilitate rotation of the curtain unit with respect to the flotation unit and the weighted base.

2. The containment unit of claim 1, wherein the weighted base further comprises at least one first winch that facilitates stretching the curtain unit towards a surface of the ambient fluid.

3. The containment unit of claim 1, wherein the flotation unit further comprises one or more gas cylinders for injecting air into the flotation unit to lift the flotation unit towards a surface of the ambient fluid; and at least one second winch positioned inside the flotation unit, wherein the second winch facilitates stretching the curtain unit, wherein the one or more gas cylinders and the winch control an ascent speed of the flotation unit towards the surface of the ambient fluid.

4. The containment unit of claim 1, wherein the containment unit further comprises a surface flotation unit comprising one or more sensors, associated with the one or more pumps, for monitoring a flow of the fluid leak collected in the containment unit.

5. The containment unit of claim 1, wherein the curtain unit comprises a primary curtain housing and a secondary curtain housing, the primary curtain housing comprises a primary curtain and the secondary curtain housing comprises a secondary curtain.

6. The containment unit of claim 5, wherein the primary curtain is lifted using a first winch, and the secondary curtain is lifted using a second winch.

7. The containment unit of claim 6, wherein the primary curtain and the secondary curtain are flexible.

8. The containment unit of claim 1, wherein the curtain unit comprises a curtain fabric and a curtain connection ring.

9. The containment unit of claim 8, wherein the curtain connection ring connects a top part of the curtain unit to a bottom part of the flotation unit.

10. A containment system, comprising the containment unit of claim 1, wherein the weighted base surrounds a blowout preventer (BOP) that is coupled to a marine riser.

11. The containment system of claim 10, wherein the weighted base is positioned on top of one or more suction piles, using remotely operated vehicles (ROV) or divers.

12. The containment system of claim 11, wherein the one or more suction piles are placed in a pre-defined location on a seafloor, with guide wires to a surface, to place the containment unit in correct orientation and position.

13. The containment system of claim 10, wherein the flotation unit is anchored to seabed or tugboats or barges.

14. The containment system of claim 10, wherein the system comprises one or more containment units based at least on depth of the ambient fluid at a drilling site.

15. The containment system of claim 14, further comprising guide rings and guide wires disposed on an outer area of the containment unit.

16. The containment system of claim 15, wherein the guide rings and guide wires guide a coupling of the one of more containment units.

17. The containment system of claim 10, wherein the fluid is a hydrocarbon solution.

18. A method for containing fluid leaks in an ambient liquid using the containment unit of claim 1, the method comprising the steps of:

installing one or more suction piles on a seabed around a blowout preventer;

deploying the containment unit moored to the one or more suction piles by releasing the flotation unit;

anchoring the flotation unit;

dropping and deploying subsequent containment units from a vessel until a surface of ambient liquid is reached;

coupling a surface flotation unit to the flotation unit on the surface; and collecting the leaked fluid.

19. The method of claim 18, wherein the flotation unit further comprises:

one or more pumps for injecting air into the flotation unit to lift the flotation unit towards a surface of the ambient fluid; and a winch positioned inside the flotation unit, wherein the winch facilitates stretching the curtain unit, wherein the one or more pumps and the winch control an ascent speed of the flotation unit towards the surface of the ambient fluid.

* * * * *